US005498179A

United States Patent [19]

Byczek

[11] Patent Number: 5,498,179

[45] Date of Patent: Mar. 12, 1996

[54] ELECTRICAL CONNECTOR

[75] Inventor: Roger W. Byczek, Lake in the Hills, Ill.

[73] Assignee: Woodhead Industries, Inc., Northbrook, Ill.

[21] Appl. No.: 238,246

[22] Filed: May 4, 1994

[51] Int. Cl.[6] ..... H01R 11/22

[52] U.S. Cl. ..... 439/843; 439/856

[58] Field of Search ..... 439/842, 843, 439/851, 854, 855, 856, 861, 578–585, 839, 833

[56] References Cited

U.S. PATENT DOCUMENTS

| | | | |
|---|---|---|---|
| 4,374,606 | 2/1983 | Lathrop | 439/843 |
| 4,550,972 | 11/1985 | Romak | 439/851 |
| 4,685,761 | 8/1987 | Locati | 439/843 |
| 4,734,064 | 3/1988 | Knapp et al. | 439/856 |
| 4,834,681 | 5/1989 | Chaillot | 439/856 |
| 5,199,910 | 4/1993 | Kahle et al. | 438/843 |
| 5,322,459 | 6/1994 | Spinnato | 439/843 |

*Primary Examiner*—David L. Pirlot
*Attorney, Agent, or Firm*—Emrich & Dithmar

[57] ABSTRACT

An improved female connector element for a pin and socket electrical connector includes at least four flexible fingers or "cantilever beams" forming a cylindrical socket for the pin of a male connector. A cylindrical sleeve surrounds the fingers and extends beyond their free ends to form an inwardly extending annular guide lip which defines the inlet opening for the pin. The lip both guides the pin properly into the socket and limits the size of the pin that may be inserted, thereby reducing potential damage to the fingers while providing a reliable, durable connector.

12 Claims, 2 Drawing Sheets

FIG. 6
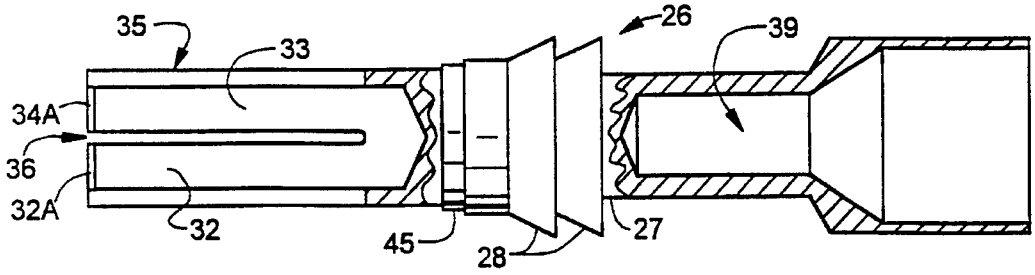
FIG. 7
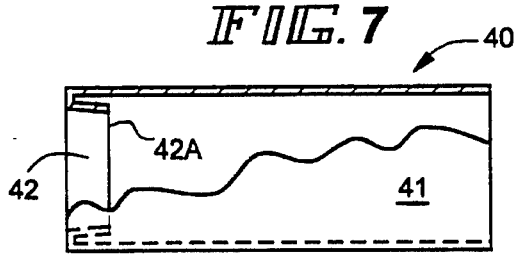
FIG. 8
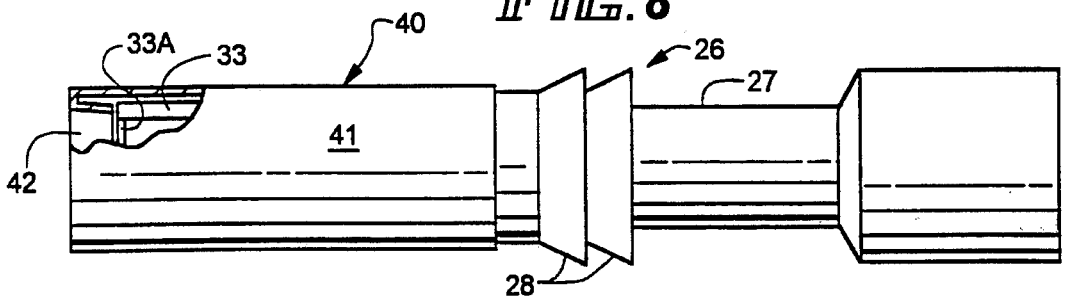
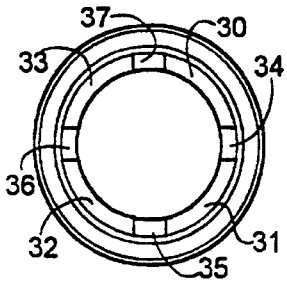
FIG. 9

ELECTRICAL CONNECTOR

FIELD OF THE INVENTION

The present invention relates to electrical connectors; and more particularly, it relates to pin and socket electrical connectors of the type used in many industrial uses for low power, signal communications or control signal applications.

BACKGROUND OF THE INVENTION

The female contact of current commercial pin and sleeve electrical connectors, in one common form, has two opposing, semi-cylindrical fingers (or "beams" as they are sometimes called). Together, they form an elongated, cylindrical socket or female receptacle for a male connector pin, both fingers being integral with and extending from a common base in cantilever. Thus, each of the fingers extends from a common base, outwardly in a semi-cylinder to a distal end. Together they form a split cylinder—i.e., the socket. The semi-circular distal ends of the two fingers form an inlet opening to the socket through which the pin is placed in making a connection.

A cylindrical sleeve is located around the outer edges of the fingers and it extends from the base of the fingers to a location short of the outermost or distal ends of the fingers. In other words, the outermost ends of the fingers, in the prior art, extend out of the sleeve at the location where they receive the connector pin in mating coupling. The cylindrical sleeve thus limits the outward flexing of the fingers at their base, but it leaves the inlet ends free, where damage can occur.

Typically, connectors of this type have two through five or more poles, each pole being represented by a mating pin of a male connector and a corresponding socket of a female connector. All of the connector elements for both the male and the female connectors are held in place by a plastic body called an insert. An electric cable having a conductive wire for each pole is assembled to each male and female connector, with a wire attached to each connector element; and a covering or sheath of soft insulating plastic is molded to bridge the jacket of the cable to the insert, thereby enclosing and sealing the connections of the electrical wires to the connector elements. Thus, these connectors are frequently referred to in the industry as "molded" connectors.

In connectors of this type, the primary mechanism for limiting the diameter of a pin being inserted is the opening formed in the plastic insert body just beyond the outer-most extension of the fingers. However, the insert body, being formed of a pliable, molded plastic, deforms under force, so that it is not uncommon for a person to attempt to assemble a male connector having oversized pins into a corresponding female connector. This may lead to damage.

Experience has shown there are two problems with the female connector in the prior art structure. It must be realized that molded connectors are typically used in industrial or commercial applications and that they experience rugged conditions of use. The pins may be stepped on or otherwise mishandled so that one or more of the pins become misaligned (i.e., out of parallel) with the other pins of the male connector. During assembly to a female connector, a misaligned pin may cause damage to the socket. In assembling the male connector to a female connector, even if the pins are not misaligned, molded connectors are frequently subjected to rough handling so that one or more of the pins of the male connector are not properly aligned with the axis of the associated female socket into which it is being inserted. This can also cause damage to the socket elements.

Thus, a common failure is caused by misalignment of the pin during insertion. This can cause a bending of the flexible finger at the inlet opening of the socket because the finger extends beyond, and is therefore not supported by, the surrounding metal cylindrical sleeve. The damage is exacerbated because of the shape of the fingers (i.e., semi-cylindrical) and because of the characteristics of the type of brass material from which these contacts are conventionally made. That is, they are machined from a brass alloy which is somewhat brittle so that it rather easily is deflected beyond its normal stress-deflection characteristic. When this occurs, the metal is overstressed and may even tear. In either case, it will lose its resilient characteristic; and its ability to establish reliable electrical continuity is then lost.

A second problem which also results from the stiffness and shape of the semi-cylindrical fingers of the prior art construction is that they are susceptible to damage if a pin having a diameter larger than that for which the female connector is designed, is inserted into the female socket. Again, the rugged conditions of industrial applications must be borne in mind. It is not uncommon for a user to force an oversized pin into a smaller socket. If an oversized pin is attempted to be assembled to a smaller female socket, the inlet ends of both semi-circular fingers are bent outwardly and about the edge of the protecting sleeve where failure occurs if the fingers are bent with sufficient force.

SUMMARY OF THE INVENTION

The present invention improves the female socket of a pin and socket connector to overcome the two common failure modes mentioned above-namely, bending of the flexible fingers of the female socket beyond their normal stress limits due to either an attempt to insert an oversized pin, or the insertion of a normal size pin but in a misaligned orientation relative to the axis of a socket. Both of these failure modes cause, as mentioned above, flexure of the flexible fingers of the female socket beyond their normal stress limits so that the necessary resilience of the fingers is lost.

The present invention improves the force/deflection characteristics of the flexible fingers by reducing the circumferential extension of the fingers. Thus, rather than having the fingers extend in a radial arc (or "sector") of approximately 180° about the axis of the female socket, whereby the flexible fingers form a semi-cylinder, the present invention provides that the fingers extend through a sector of approximately 90° so that there are four separate fingers, arranged in quadrature about the axis of the socket. Each individual finger moreover, is much more "flat" in the sense that its connection to the base of the connector element is of reduced arc and reduced extension. Thus, the fingers of the present invention are more flexible for a given force than are the fingers of the prior art, even when they are made of the same material as the prior art, due to the structure just described.

A metal sleeve surrounds the fingers and extends beyond their free ends to form an inwardly turned, rearwardly extending continuous lip forming an annular guide surface which defines the inlet aperture to the socket.

The protective structure of the annular lip of the sleeve and the additional flexibility of the fingers cooperate to provide an improved female socket for a pin connecting element, with greater reliability of electrical continuity and having a substantially increased ability to withstand the rugged conditions of use for molded connectors of this type, without improved reliability.

Other features and advantages of the present invention will be apparent to persons skilled in the art from the following detailed description of a preferred embodiment accompanied by the attached drawing wherein identical reference numerals will refer to like elements in the various views.

BRIEF DESCRIPTION OF THE DRAWING

FIG. 6 is a side view of an improved female connector element constructed according to the present invention with portions shown in section;

FIG. 7 is a partially sectioned side view of the sleeve of the improved female connector element;

FIG. 8 is a side view of the improved female connector of the present invention with the sleeve assembled to the connector element, but with the upper left hand portion of the sleeve and the socket partially sectioned to show the interior thereof; and FIG. 9 is a left side view of the female connector element shown in FIG. 6.

DETAILED DESCRIPTION OF A PREFERRED EMBODIMENT

Figure 2:
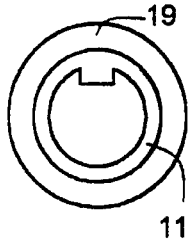
FIG. 2 PRIOR ART
FIG. 2 is a left side view of the prior art connector of FIG. 1.
Figure 1:
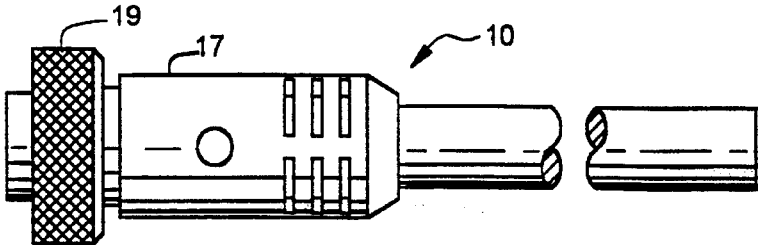
FIG. 1 PRIOR ART
FIG. 1 is a side view of a molded connector in the prior art, with the cable foreshortened.

Referring first to the prior art connector shown in FIGS. 1–5, reference numeral 10 generally designated a female molded connector. The connector 10 includes a body 11 of low durometer (that is, flexible) plastic in which female connector elements, described below, are embedded. The combination of connector body 11 and connector elements is referred to as an insert. The connector elements are, in turn, connected to individual wires such as those designated 12 in FIG. 3 which are enclosed in an insulating cover or sheath generally designated 13 to form a multi-conductor cable generally designated 15.

Figure 3:
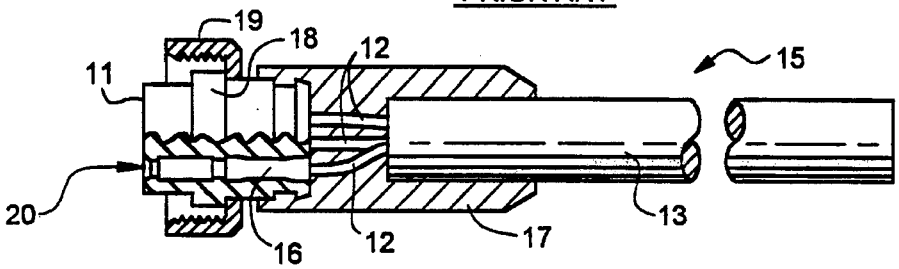
FIG. 3 PRIOR ART
FIG. 3 is a vertical sectional view of the prior art connector of FIG. 1, taken parallel to the plane of the page.

After the electrical connections are made between the wires 12 and the female connecting elements of the insert, one of which is designated 16 in FIG. 3, a portion of the connector designated 17 is molded to seal the cable 15 to the insert 11. The molded body 17 not only hermetically seals the electrical connections made between the wires and the connector elements, but it also provides mechanical strength and cushioning protection to the wires and the connector body and elements.

For reference purposes, when referring to various parts of the connector, the "inner" end is the one closest to the cable 15, and the "outer" end or portion is that which is closest to the male pin connector during assembly.

The connector body 11 is provided with a circumferential rim 18, and an internally threaded coupling nut 19 is located on the insert body 11 to mechanically couple with a correspondingly threaded exterior screw portion of a mating male connector having pins. The pins are received in sockets generally designated 20 of the female connector elements so that after the male connectors or pins are inserted into the sockets 20 of the female connectors 16, the nut 19 is screwed onto a corresponding exterior thread attached to the insert of the male connector, and the connectors are secured together in a manner familiar to those skilled in the art.

Figure 5:
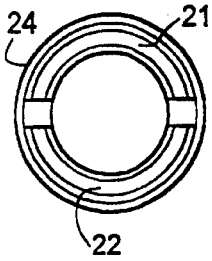
FIG. 5 PRIOR ART
FIG. 5 is a left side view of the female connector element of the prior art shown in FIG. 4.
Figure 4:
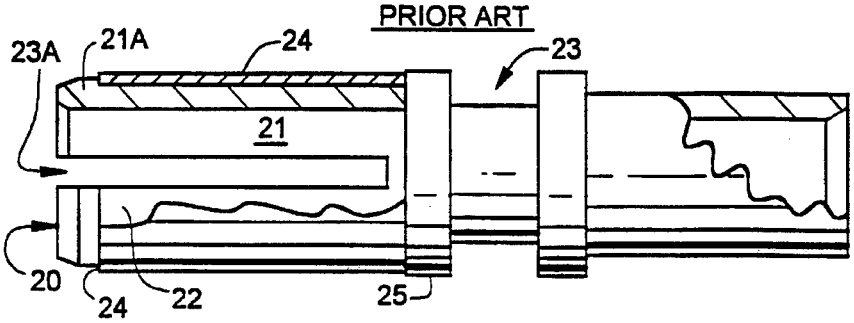
FIG. 4 PRIOR ART
FIG. 4 is an enlarged side view of the female connector element of the prior art connector of FIG. 1 with portions shown in section.

Referring now in particular to FIGS. 4 and 5, the socket 20 includes first and second semi-cylindrical fingers 21, 22 extending from a base 23 of the female connector element. These fingers are typically formed by machining the cylindrical bore into the body of the female connector element to the desired depth and then forming a single cut **23*a*** diagonally across the socket and through the axis of the bore.

A cylindrical metal collar 24 surrounds the fingers 21, 22. The interior surface of the collar 24 is spaced slightly outwardly of the outer surface of the fingers 21, 22 to permit the fingers to flex, and the collar extends in an axial direction from a raised annular rib 25 of the base 23 to a location defined by edge **24*a* located slightly inboard of the free ends of the cantilever fingers 21, 22, leaving the free ends, such as that designated 21*a*, unprotected by the sleeve 24**.

Turning now to FIGS. 4–7, there is shown the improved female or socket connector element of the present invention. Persons skilled in the art will appreciate that there is a female connector element for every corresponding male pin connector element, and that the improved female elements are embedded in a connector body and connected to the wires of the associated cable as they have been in the past.

Turning then to FIG. 6–8, the improved female or socket connector element is generally designated 26. It includes a cylindrical base 27, a pair of circumferential barbs 28 to secure the female connector element in its associated connector body, and a set of four flexible fingers designated 30, 31, 32 and 33 in FIG. 9. The fingers 30–33 are arranged in quadrature to form a socket generally designated 35 in FIG. 6 for receiving an associated pin connector. The sides of the fingers 30–33 are defined by slots 34–37.

As indicated in FIG. 9 the fingers 30–33 each extend about the axis of the socket for a sector of slightly less than 90° (i.e., 90° less the width of a slot). The inner surface of the outer edge of each finger is beveled at 30°, as seen at **33*a* and 32*a* for fingers 33 and 32 respectively in FIG. 7**. All of the fingers have pin-engaging surfaces forming sectors of a cylinder, similar to those found in conventional sockets.

As mentioned above, it will be observed from FIG. 9 that each of the fingers or beams extends in a radial sector arc of approximately 90°; and it can also be observed that each of the quadrature fingers is substantially more flat (i.e., when viewed on end) than the two semi-cylindrical fingers of the prior art shown in FIG. 5. These flatter contours not only provide more flexibility to the individual fingers relative to their base, but they exhibit a much lower tendency toward tearing or excessive stressing of the metal if the fingers are bent backward on themselves. (By "backward", it is meant that the outermost portion of the finger is bent relative to the base by moving it in a direction radially away from the axis of the socket.) Persons skilled in the art will thus appreciate that the fingers may be made even more flat than shown in FIG. 9 by increasing the number of fingers, for example, to six or eight, while attaining the advantages of the present invention.

The inner portion of the base 27 of female connector element 26 there is formed into a receptacle generally designated 39 for receiving a wire from its associated feed cable. The wire may be crimped or soldered in place, providing both electrical and mechanical connection at the same time.

Turning now to FIGS. 7 and 8, reference numeral 40 generally designates a sleeve having a cylindrical wall 41 and an inwardly turned annular lip 42. The sleeve 40 is received over, and surrounds, the quadrature finger arrangement of the socket 35, and the innermost end of the sleeve (that is, the end opposite the inwardly turned lip 42) is received on a neck portion 45 adjacent the base of the quadrature finger socket 35 in an interference fit.

The length or axial dimension of the sleeve 40 is such that when the innermost end of the sleeve is forced onto the collar 45 of the female connector element, the inner or free edge 42*a* of the lip 42 is slightly outboard of the free or distal end 45 of the cantilever fingers 30–33 (see FIG. 8). Thus, the fingers are free to flex outwardly, but a pin being inserted is centered on the axis of the socket due to the guiding action of the annular lip 42. Moreover, it will be appreciated that the cylindrical wall 41 of the sleeve 40 is spaced slightly radially outwardly of the fingers 30–33 so as to permit them to flex; but at the same time, the cylindrical wall 41 acts as a limit for the outer flexing of the fingers throughout their entire length. That is, no part of any finger may be bent outside the contour of the wall 41 of the sleeve. Moreover, the inner surface of the inwardly turned lip 42 of the sleeve 40 acts both as a guide in inserting a pin into the female socket, and also as a limit for the diameter of pin that may be inserted. This is in contradistinction to the prior art which, as described above, used the soft plastic, such as polyvinylchloride, material of the insert body not only to guide the pin being inserted into the socket, but also to limit the size of the pin being inserted.

The guiding function of the lip 42 is enhanced because it is of progressively reduced diameter proceeding in the direction of pin insertion, best seen in FIGS. 7 and 8.

In summary, the present invention provides an improved cantilever beam or flexible finger type of female socket for an electrical connector element having enhanced flexibility, greater reliability in establishing repeated electrical contacts, and greater resistance to misuse either by the insertion of misaligned pins or the insertion of pins having a diameter larger than that for which the socket is designed to receive.

Another advantage of the present invention, which is not apparent from the above description, is that in the manufacturing operation, a wider variation in a critical tolerance is permitted with the quadrature beam structure of the present invention than was permitted with the dual-beam structure of the prior art shown in FIGS. 1–5. To understand this advantage, it must first be understood that in manufacturing, a tolerance is set on the inner diameter of the socket, after it is formed. Next, the slots in the side wall of the socket are formed to define the fingers. This is so in manufacturing both dual-beam structures and quadrature beam structures. Next, the fingers are "spanked" (i.e., formed under pressure to a reduced diameter) and the diameter of the socket then must meet established tolerances in order to exert the required pressure on an inserted pin to establish reliable electrical continuity in the connector. This tolerance of the diameter of the bore of the socket, after spanking, is greater for the quadrature beam structure of the present invention. This reduces manufacturing costs.

Having thus disclosed in detail a preferred embodiment of the invention, persons skilled in the art will be able to modify certain of the structure which has been illustrated (for example, by adding fingers), and to substitute equivalent elements for those disclosed while continuing to practice the principle of the invention; and it is, therefore, intended that all such modifications and substitutions be covered as they are embraced within the spirit and scope of the appended claims.

I claim:

1. An improved multiple-pole female electrical connector for assembly with a male electric connector having a plurality of pins, said female connector having a plurality of female connector elements embedded in a connector insert body and adapted to receive and establish electrical continuity with associated ones of said pins, each female connector element comprising: an integral conductive metal connector having a base, at lest four flexible fingers arranged in diametrically opposed pairs to form a cylindrical socket, for receiving an associated pin for making an electrical connector, each finger extending from said base in cantilever and being flexible in a direction radial of said socket and independently of the other fingers, each finger having a distal free end adapted to engage an associated pin and establish electrical contact therewith; and a protective metal sleeve coaxial with the axis of said socket and surrounding said fingers to limit the outward flexing of said fingers, said sleeve having an inwardly turned annular lip at the inlet end thereof, said lip defining an insertion opening substantially equally coextending with the insertion opening defined by said distal free ends of said fingers of said female connector element, said lip forming a guide for an associated pin during insertion of said pin in said socket, said lip extending to an axial location adjacent to, but spaced slightly outwardly of, the distal free ends of said fingers, whereby said lip of said sleeve receives and guides a pin during insertion in said socket and limits the size of pin that may be received in said socket, and the cylindrical wall of said sleeve limits the outward deflection of said fingers to preclude overstressing said fingers, and characterized in that said fingers do not normally engage said sleeve and are free to move upon insertion of a pin in said socket.

2. The apparatus of claim 1 further characterized in that each of said fingers forms a portion of a cylindrical wall of said socket and that each finger extends in a radial sector of less than 90° of the circumference of a circle defined by a cross section of said socket wall.

3. The apparatus of claim 1 wherein said flexible fingers consist of four fingers of equal circumferential extension about said cylindrical socket and cooperating with their distal ends forming an inlet opening to receive a pin, said fingers being separated by slots extending from said inlet opening parallel to the axis of said socket.

4. The apparatus of claim 3 further comprising at least one annular barb portion extending outwardly of said base to secure said female connector element in a connector insulating body.

5. The apparatus of claim 3 further comprising a receptacle on said base for receiving a wire of a cable and coupling said wire to said socket.

6. The apparatus of claim 1 wherein said sleeve comprises a cylindrical wall mounted to said base of said female connector element and includes a distal end located outwardly of the distal ends of said fingers.

7. The apparatus of claim 6 wherein said annular lip of said sleeve extends inwardly of the distal end thereof and toward said base, the inner end of said lip being located outwardly of the distal ends of said fingers for guiding a pin during the making of a connection into the inlet opening defined by said distal ends of said fingers while permitting said fingers to flex outwardly toward the cylindrical wall of said sleeve.

8. An improved female electrical connector having a plurality of female connector elements adapted to receive and establish electrical continuity with associated male connector pins, each female connector having a base, at least four flexible fingers arranged in pairs of opposing cantilever contact elements to form a cylindrical socket, for receiving an associated pin for making an electrical connection, each finger extending from said base in cantilever and being flexible in a radial direction independently of the other fingers; and a protective sleeve coaxial with the axis of said socket and surrounding said fingers to limit the outward flexing of said fingers.

9. The apparatus of claim 8 characterized in that each of said fingers forms a portion of a cylindrical wall of said socket and that each finger extends in a radial sector of less than 90° of the circumference of a circle defined by a cross section of said socket wall.

10. The apparatus of claim 8 wherein said flexible fingers consist of four fingers of equal circumferential extension about said cylindrical socket and cooperating with their distal ends forming an inlet opening to receive a pin, said fingers being separated by slots extending from said inlet opening parallel to the axis of said socket.

11. The apparatus of claim 10 further comprising at least one annular barb portion extending outwardly of said base to secure said female connector element in a connector insulating body.

12. The apparatus of claim 11 further comprising a receptacle on said base for receiving a wire of a cable and coupling said wire to said socket.

* * * * *